US007661284B2

(12) United States Patent
Iida

(10) Patent No.: US 7,661,284 B2
(45) Date of Patent: Feb. 16, 2010

(54) APPLICATION METHOD OF CR-PLATED MANDREL BAR FOR HOT ROLLING

(75) Inventor: Sumio Iida, Osaka (JP)

(73) Assignee: Sumitomo Metal Industries, Ltd., Osaka-shi (JP)

( * ) Notice: Subject to any disclaimer, the term of this patent is extended or adjusted under 35 U.S.C. 154(b) by 0 days.

(21) Appl. No.: 12/211,688

(22) Filed: Sep. 16, 2008

(65) Prior Publication Data

US 2009/0013750 A1 Jan. 15, 2009

Related U.S. Application Data

(63) Continuation of application No. PCT/JP2007/068362, filed on Sep. 21, 2007.

(30) Foreign Application Priority Data

Jun. 11, 2007 (JP) ..... 2007-154311

(51) Int. Cl.
*B21B 17/10* (2006.01)

(52) U.S. Cl. ..... 72/208; 72/47; 72/236

(58) Field of Classification Search ..... 72/96, 72/97, 208, 209, 47, 476, 236
See application file for complete search history.

(56) References Cited

U.S. PATENT DOCUMENTS 7,165,431 B2 * 1/2007 Iida et al. ..... 72/208
7,308,812 B2 * 12/2007 Iida et al. ..... 72/42

FOREIGN PATENT DOCUMENTS

| | | |
|---|---|---|
| JP | 07-214116 | 8/1995 |
| JP | 08-071618 | 3/1996 |
| JP | 08-243610 | 9/1996 |

(Continued)

OTHER PUBLICATIONS

International Search Report in corresponding PT/JP2007/068362 dated Dec. 18, 2007 (Japanese only).

(Continued)

*Primary Examiner*—Edward Tolan
(74) *Attorney, Agent, or Firm*—Marshall, Gerstein & Borun LLP

(57) ABSTRACT

The present invention provides an application method of a Cr-plated mandrel bar repeatedly used in mandrel mill rolling by the Mannesmann tube making process. A regeneration treatment is performed to use the mandrel bar again as a tool of like size when an opening width H of a surface defect generated on the mandrel bar by its use in the mandrel mill rolling is not less than 1.5 mm and a depth of the surface defect is in the range of 0.3 mm to less than 2.0 mm. Alternatively, a downsizing treatment is performed to use the mandrel bar again as a tool of a smaller size when the depth of the surface defect generated on the mandrel bar by its use in the mandrel mill rolling is not less than 2.0 mm. The regeneration treatment or downsizing treatment is performed according to conditions or a configuration of the surface defect to achieve repeated application to the mandrel mill rolling, allowing life-extension of the mandrel bar and improvement of cost performance thereof.

2 Claims, 2 Drawing Sheets

FOREIGN PATENT DOCUMENTS

| | | | |
|---|---|---|---|
| JP | 08-294711 | | 11/1996 |
| JP | 11-226614 | | 8/1999 |
| JP | 2000-246312 | * | 9/2000 |
| JP | 2000-343109 | | 12/2000 |
| JP | 2000-351007 | * | 12/2000 |
| JP | 2001-1016 | * | 1/2001 |
| WO | 2004/108311 | * | 12/2004 |

OTHER PUBLICATIONS

Written Opinion in corresponding PT/JP2007/068362 dated Dec. 18, 2007 (Japanese only).

* cited by examiner

[REGENERATION TREATMENT]

[DOWNSIZING TREATMENT]

APPLICATION METHOD OF CR-PLATED MANDREL BAR FOR HOT ROLLING

TECHNICAL FIELD

The present invention relates to an application method of a Cr-plated mandrel bar to be used in mandrel mill rolling in the Mannesmann tube making process, particularly to an application method of the Cr-plated mandrel bar, which can repeatedly be employed to the rolling, the method comprising performing a regeneration treatment or a downsizing treatment according to a configuration of a surface defect caused by seizure and/or wear even if said surface defect is generated by mandrel mill rolling.

BACKGROUND ART

The Mannesmann-mandrel mill tube making process is widely adopted as a method for producing a seamless tube by hot working. In the mandrel mill rolling, the rolling is performed using multi-stand caliber rolls, which provide movements in an axial direction to a hollow shell while constraining/defining an outer surface of the hollow shell, and a mandrel bar, which constrains/defines an inner surface of the hollow shell. Therefore, the mandrel bar is an important tool which determines inner surface quality of the rolled hollow shell.

FIG. 1 is a view explaining a process of producing a mandrel bar used in mandrel mill rolling. Usually hot-work tool steels such as SKD6 and SKD61 (JIS standard) are used as materials for the mandrel bar. An ingot melted and prepared with a relevant chemical composition of a hot-work tool steel is bloomed and rolled, and a predetermined heat treatment is performed to obtain a bar material (a blank to be processed). Since the bar material is bent/crooked due to the heat treatment, the bends are corrected/straightened by a rotary straightener, and an outside machining device is used to machine the bar material into a predetermined outside diameter. And then, finish-polishing or surface treatment is performed to the surface of the workpiece, and plating is performed, whereby the process can repeatedly be applied to the mandrel mill rolling.

As described above, in the Mannesmann-mandrel mill tube making process, a thick hollow shell that is obtained by piercing through the heated round steel piece (billet) using a piercer is rolled into a thin hollow shell by plural roll-stands each comprising caliber rolls that are aligned as opposed to each other while the mandrel bar, which constrains the inner surface of the hollow shell, is inserted. The hollow shell to which the mandrel mill rolling is performed is re-heated if needed and rolled to a predetermined diameter to produce a final hot rolled product using a stretch reducer or a sizer.

Usually, in the mandrel bar employed in the mandrel mill rolling, a lubricating film comprising mainly solid-state lubricants is formed in advance on the surface of the mandrel bar to decrease frictional force incurred on the contact surface between the mandrel bar and the hollow shell, whereby generation of defects either on the tool surface or on the inner surface of the hollow shell is prevented.

However, the mandrel bar is repeatedly used, whereas the formed lubricating film disappears after one-time use of the mandrel bar in the mandrel mill rolling, so that the lubricating film needs to be formed again on the surface of the mandrel bar to use the mandrel bar in the next rolling. Accordingly, after the mandrel bar is once used in the rolling, the mandrel bar is cooled by water-cooling shower or the like, lubricants are coated over its surface, and the lubricants are completely dried to form the lubricating film.

As described above, the mandrel bar is made of a hot-work tool steel such as SKD6 or SKD61, and obtained by means of appropriate machining, quenching, and tempering. Since the surface of the mandrel bar bears a huge surface pressure and is exposed to a huge heat load during the rolling, the stable lubrication is hardly maintained. Therefore, the surface defects are likely to occur on the surface of the mandrel bar in association with repeated use of the mandrel bar in the mandrel mill rolling.

Conventionally, various countermeasures are studied against generation of surface defects on the surface of the mandrel bar. For example, Japanese Patent Application Publication No. 8-243610 discloses a life-extension method in which, after an outside surface of mandrel bar that is deteriorated in surface characteristics is polished by about 0.04 mm using a belter, rusting operation is applied on the surface of the mandrel bar at ambient temperature or by heating the mandrel bar to 100° C., and the mandrel bar is reused as the mandrel bar of like size.

However, the intended mandrel bar of Japanese Patent Application Publication No. 8-243610 is the one which premises a scaling treatment. Since recently the mandrel bar to which a hard Cr plating treatment is performed is mainly used to improve a wear-resistant property, the life-extension method disclosed in Japanese Patent Application Publication No. 8-243610 cannot be applied to such a case. Surface roughening is concerned in the mandrel bar to which a scaling treatment is performed, while the generation of surface defects is concerned in the mandrel bar to which the Cr plating treatment is performed.

Japanese Patent Application Publication No. 07-214116 proposes a mandrel bar for seamless tube rolling in which, even if wear or surface defects are generated on the surface of mandrel bar, wherein the mandrel bar is not partially disposed, and is configured such that a body portion of the mandrel bar is covered with plural sleeves to thereby allow the mandrel bar to be reused by making it possible to exchange this sleeve(s) when needed upon generation of damages thereon, thus enabling to improve cost performance of the tool, or tool costs per production unit.

However, in the mandrel bar proposed in Japanese Patent Application Publication No. 07-214116, since the body portion of the mandrel bar is covered with the plural sleeves, the production cost of the mandrel bar is largely increased, and a serious accident such as deformation/distortion and/or coming-off of this sleeve(s) is possibly induced during the rolling.

DISCLOSURE OF THE INVENTION

As described above, recently the mandrel bar in which the Cr plating treatment is performed to form the hard Cr plating film is used to improve the wear-resistant property. However, when the Cr plating treatment is performed to the mandrel bar, although the generation of surface defects becomes troublesome in the mandrel bar, conventionally there has not been developed an art for effectively preventing such troubles.

On the other hand, a ratio of tool costs, particularly a ratio of the cost for producing a mandrel bar is increased in production cost for producing a seamless tube by the Mannesmann-mandrel mill tube making process. Therefore, life-extension of the mandrel bar and the improvement of the tool cost per production unit thereof become an important issue in producing the seamless tube by the Mannesmann-mandrel mill tube making process.

In view of such a problem, an object of the present invention is to provide an application method of the Cr-plated mandrel bar that can repeatedly be employed to the rolling for the life-extension and the improvement of cost performance of the mandrel bar by performing the regeneration treatment or downsizing treatment according to a configuration of each surface defect, even if surface defects are generated on the surface of the mandrel bar by the mandrel mill rolling.

As a result of various studies to solve the above problem, the inventors found that seizure or wear on the surface of the mandrel bar caused by the repeated rolling was mainly attributed to the deterioration of the surface conditions and/or the generation of surface defects in the mandrel bar. The inventors noted that even if surface defects were generated in the mandrel bar by the seizure or wear, the life-extension of the mandrel bar was achieved by performing a conditioning treatment according to the configuration of each of these surface defects.

FIG. 2 is a view showing a typical configuration of a surface defect caused by seizure of the mandrel bar, whereas FIG. 2(*a*) shows an appearance of the configuration of the surface defect on the surface of the mandrel bar, and whereas FIG. 2(*b*) shows an axial cross-sectional configuration of the surface defect. A surface defect 2 shown in FIG. 2 is also called comet tail defect, and the surface defect 2 is generated in a shooting-star like shape while beginning at a seizure point P existing on the surface of a mandrel bar 1. The conditions or the configuration of the surface defect 2 can be expressed by an opening length N (mm), an opening width H (mm), and the maximum depth D (mm).

When surface defects generated on the surface of the mandrel bar becomes badly conspicuous, swelling-like defects are generated on the inner surface of the hollow shell by the mandrel mill rolling, and these swelling-like defects cannot be improved by a subsequent diameter-reducing rolling using a stretch reducer or sizer. Therefore, these swelling-like defects remain in the final hot rolled product. In such a case, after the hollow shell is finished into the hot rolled product, this swelling-like defect is detected as an inner surface defect by an ultrasonic test, and the product having swelling-like defects is rejected.

The inventors obtained findings (a) and (b) as a result of detailed study of surface defects that are generated by the repeated use of and limit a lifetime of the mandrel bar.

(a) An opening width H and depth D of surface defect on a mandrel bar have large influences on inner surface defects of hot rolled products, and generation of these inner surface defects becomes conspicuous when the opening width H of and the depth D of the surface defect generated on the mandrel bar by its use in the mandrel mill rolling are not less than 1.5 mm and not less than 0.3 mm, respectively.

However, when the opening width H of the surface defect is not less than 1.5 mm and the depth D thereof is not less than 0.3 mm, the use of the mandrel bar in the mandrel mill rolling is suspended and a regeneration treatment is performed to the mandrel bar, allowing the generation of inner surface defects due to the above surface defect to be suppressed.

(b) Usually, a standardized tube-making schedule s established in producing the seamless tube by the Mannesmann-mandrel mill tube making process wherein standard sizes for mandrel bars are set in themselves, while a mandrel bar(s) of certain size(s) is more frequently used. Therefore, it is preferable that the configuration of the surface defect is controlled and the regeneration treatment is performed as much as possible to use the mandrel bar as the tool of like size. However, the regeneration treatment can be hardly performed when the depth D of the surface defect becomes not less than 2.0 mm due to the use in the mandrel mill rolling.

In such a case, a downsizing treatment is performed by machining an outside circumferential surface of the mandrel bar, and the mandrel bar is used again as a tool of a smaller size, which allows the total cost performance to be improved over the whole sizes of the mandrel bar.

The present invention is completed based on the above-described findings, and mainly pertains to application methods of a hot rolling Cr-plated mandrel bar as described in (1) to (3) below.

(1) An application method of a hot rolling Cr-plated mandrel bar repeatedly used in mandrel mill rolling by the Mannesmann tube making process, being characterized in that, when an opening width H of a surface defect generated on the mandrel bar by its use in the mandrel mill rolling is not less than 1.5 mm and a depth D of the surface defect is in the range of 0.3 mm to less than 2.0 mm, a plated film is removed after the relevant surface defect is conditioned, finish-polishing or surface treatment is performed to the surface of the workpiece, and following re-plating allows to use the reclaimed mandrel bar as a tool of like size.

(2) In the application method of the hot rolling Cr-plated mandrel bar (1), it is preferable that the surface of the mandrel bar is smoothly rounded off in conditioning the surface defect such that a conditioned length L1 (mm) in a longitudinal direction of the surface of the mandrel bar, a conditioned length L2 (mm) in a circumferential direction thereof and a depth D (mm) of the surface defect satisfy the following equations (1) and (2).

$$50 \leqq L1/D \quad (1)$$

$$20 \leqq L2/D \quad (2)$$

(3) An application method of a hot rolling Cr-plated mandrel bar repeatedly used in mandrel mill rolling by the Mannesmann tube making process, being characterized in that, when a depth D of a surface defect generated on the mandrel bar by its use in the mandrel mill rolling is not less than 2.0 mm, after an outside circumferential surface of the mandrel bar is machined, finish-polishing or surface treatment is performed to the surface of the workpiece, and then, a downsizing treatment is performed by plating, thereby enabling the mandrel bar to be used again as a tool of a smaller size.

As used herein, the term "surface defect" shall be caused by the seizure generated only during the mandrel mill rolling as shown in FIG. 2, and a heat crack-shape defect having a narrow opening width is excluded from a relevant item to be subjected to the downsizing treatment even if the depth D of the defect is not less than 2.0 mm.

The "depth D (mm) of surface defect" shall mean the maximum depth of the defect.

According to the application method of a hot rolling Cr-plated mandrel bar of the present invention, the hot rolling Cr-plated mandrel bar can repeatedly be employed to the mandrel mill rolling to achieve the life-extension of the mandrel bar and the improvement of its cost performance by performing the regeneration treatment or downsizing treatment according to the configuration of the surface defect, even if the surface defect is generated in the mandrel bar by the mandrel mill rolling.

BEST MODES FOR CARRYING OUT THE INVENTION

An application method of a Cr-plated mandrel bar according to an aspect of the present invention is the one for a mandrel bar repeatedly used in mandrel mill rolling by the Mannesmann tube making process, and the method is characterized in that a regeneration treatment is performed to use the mandrel bar again as a tool of like size, when an opening width H of a surface defect generated on the mandrel bar by its use in the mandrel mill rolling is not less than 1.5 mm and a depth D of the surface defect is in the range of 0.3 mm to less than 2.0 mm.

In the application method of the present invention, when the opening width H of the surface defect generated on the mandrel bar in the mandrel mill rolling is not less than 1.5 mm and the depth D of the surface defect is in the range of 0.3 mm to less than 2.0 mm, it is necessary that the use of the mandrel bar in the rolling be suspended and the regeneration treatment be applied thereto. This is because the opening width H and depth D of the surface defect on the mandrel bar have the large influence on inner surface defects of the hot rolled product which are made through a diameter-reducing process, and the influence becomes conspicuous when the opening width H of relevant surface defect is not less than 1.5 mm and the depth thereof is not less than 0.3 mm.

In the application method of the present invention, a judgment whether or not the opening width H of relevant surface defect exceeds 1.5 mm, or the judgment whether or not the depth D of the surface defect exceeds 0.3 mm is basically made by actual measurement in periodic checkups or the like. The periodic checkups can be set in advance judging from rolling outputs (such as a rolling material, the number of rolled tubes, and a rolled length).

The mandrel bar employed in the application method of the present invention may be made of such a material usually used as a bar material in the conventional Mannesmann-mandrel mill tube making process. For example, the hot-work tool steel such as SKD6 and SKD61 defined by JIS is preferably used as the material for the mandrel bar.

Figure 1:
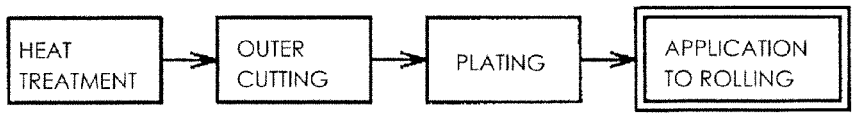
FIG. 1 is a view explaining a process of producing a mandrel bar used in mandrel mill rolling.
Figure 2A:
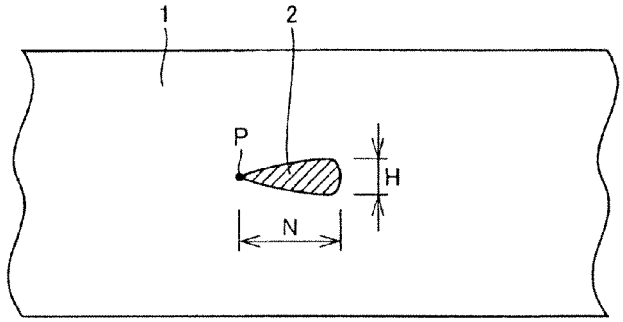
FIG. 2 is a view showing a configuration of the surface defect caused by the mandrel bar seizure, whereas FIG. 2(*a*) shows an appearance configuration of the surface defect on a surface of a mandrel bar, and whereas FIG. 2(*b*) shows a sectional configuration of the surface defect.
Figure 2B:
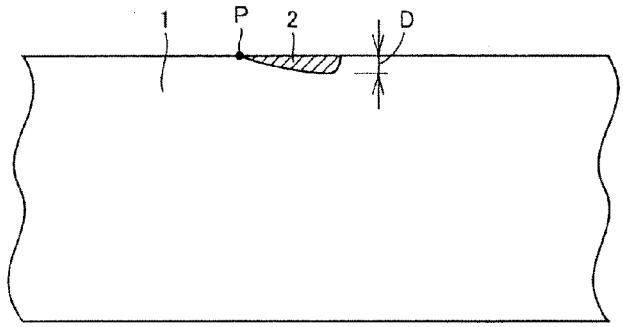
Figure 3:
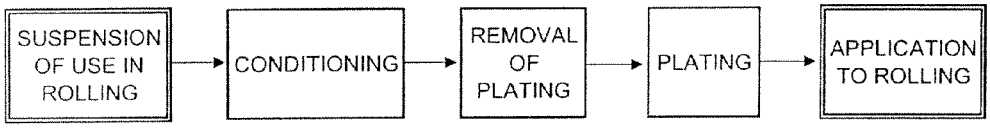
FIG. 3 is a view showing a regeneration treatment process of a mandrel bar employed in the application method of the present invention.

FIG. 3 is a view showing a regeneration treatment process of the mandrel bar adopted in the application method of the present invention. In the application method of the present invention, when the opening width H of the surface defect generated on the mandrel bar by its use in the mandrel mill rolling is not less than 1.5 mm and the depth thereof is in the range of 0.3 mm to less than 2.0 mm, the use of the mandrel bar in the mandrel mill rolling is suspended to perform the regeneration treatment thereof. In the regeneration treatment, the relevant surface defect on the mandrel bar is conditioned, the plated film thereon is removed, finish-polishing or surface treatment is performed to the surface of the workpiece, and re-plating is performed. Therefore, the mandrel bar of like size can repeatedly be used again.

In the present invention, the plated film is removed by, for example, electrochemical melting of the plated film using an alkali solution such as caustic soda or a mechanical method using a polishing machine or a grinding machine.

In the plating treatment and re-plating treatment, after the finish-polishing or surface treatment such as shot blasting is performed to the surface of the workpiece, a chromium plated film having a thickness of about 50 μm is formed.

Figure 4A:
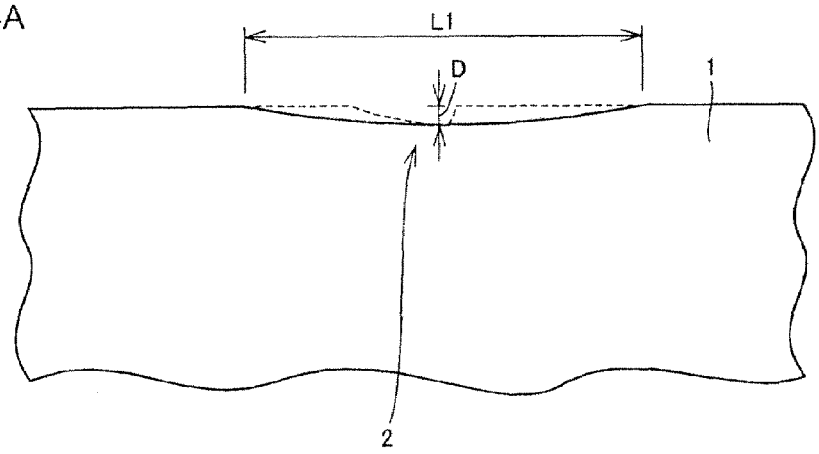
FIG. 4 is a view explaining a method for conditioning the surface defect adopted in the application method of the present invention, FIG. 4(*a*) shows a method for conditioning the mandrel bar in a longitudinal direction, and FIG. 4(*b*) shows a method for conditioning the mandrel bar in a circumferential direction.
Figure 4B:
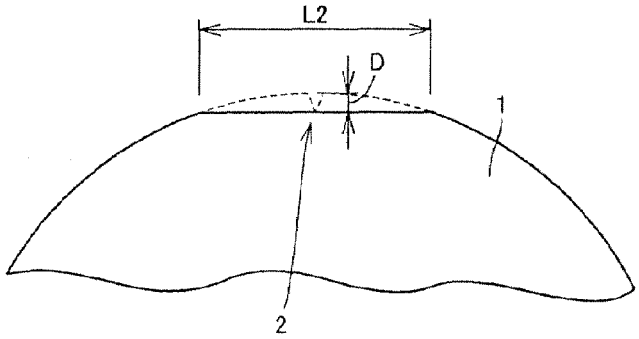

FIG. 4 is a view explaining a method for conditioning the surface defect adopted in the application method of the present invention, whereas FIG. 4(*a*) shows a method for conditioning the mandrel bar in a longitudinal direction, and whereas FIG. 4(*b*) shows a method for conditioning the mandrel bar in a circumferential direction. In FIGS. 4(*a*) and 4(*b*), in order to reach the depth D (mm) of and remove relevant surface defect 2 shown by a broken line, a conditioned lengths L1 and L2 are ensured on the surface of the mandrel bar shown by a solid line, and the conditioned portion is smoothly rounded off to the matrix surface of the mandrel bar.

In the application method of the present invention, it is preferable that a mandrel bar surface is smoothly rounded off to obtain the smooth conditioned portion such that relationships among the conditioned length L1 (mm) in a longitudinal direction of the surface of the mandrel bar, the conditioned length L2 (mm) in a circumferential direction thereof, and the depth D (mm) of the surface defect thereof satisfy the following equations (1) and (2).

$$50 \leqq L1/D \quad (1)$$

$$20 \leqq L2/D \quad (2)$$

The surface of the mandrel bar is smoothly rounded off such that the equations (1) and (2) are satisfied, and the conditioned portion is smoothly formed, whereby the deterioration of the surface conditions, the seizure and the generation of the wear in the mandrel bar can significantly be suppressed even if the mandrel bar is repeatedly used in the rolling afterwards. On the other hand, when the conditioned portion does not satisfy the relationship of the equation (1), a cross-sectional configuration of the conditioned portion comes to contain a sharp step(s), whereby metal flow of the rolled material takes place to likely damage the mandrel bar.

In the actual conditioning of the surface defect, it is necessary to do it by using a grinder or the like in such a manner that the conditioned portion is smoothly formed and the cross-sectional configuration thereof shows gentle and gradual change in shape, thereby enabling the conditioned portion to be smoothly rounded off to the matrix surface of the mandrel bar.

An application method of a Cr-plated mandrel bar according to another aspect of the present invention is the one for a mandrel bar repeatedly used in mandrel mill rolling by the Mannesmann tube making process, and the method is characterized in that a downsizing treatment is performed to use the mandrel bar again as a tool of a smaller size when the depth D of the surface defect generated on the mandrel bar by its use in the mandrel mill rolling is not less than 2.0 mm.

In the application method of the present invention, when the depth D of the surface defect generated on the mandrel bar in the mandrel mill rolling is not less than 2.0 mm, the use of the mandrel bar is suspended in the rolling to perform the downsizing treatment thereof. As described above, it is preferable that the mandrel bar is used as a tool of like size through the regeneration treatment. However, in the case where the depth D of relevant surface defect is not less than 2.0 mm, the regeneration treatment can be hardly performed.

In the application method of the present invention, the judgment whether or not the depth D of the surface defect is not less than 2.0 mm is made by the actual measurement in the periodic checkups or the like.

Figure 5:
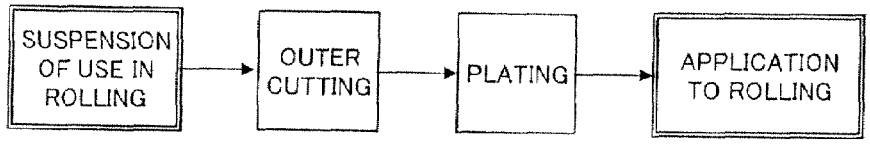
FIG. 5 is a view showing a downsizing treatment process of a mandrel bar adopted in the application method of the present invention.

FIG. 5 is a view showing the downsizing treatment process of the mandrel bar adopted in the application method of the present invention. In the application method of the present invention, when the depth D of the surface defect generated in the mandrel mill rolling is not less than 2.0 mm, the downsize treatment is performed in such a manner that after an outside circumferential surface of the mandrel bar is machined, the finish-polishing or surface treatment is performed to the surface of the workpiece, and then subjected to plating, thereby enabling the reclaimed mandrel bar to be used again as a tool of a smaller size.

In the application method of the present invention, when the outside surface machining is performed to the mandrel bar, it is necessary to ensure accuracy of an outside diameter. Since the mandrel bar usually has a longer length ranging 15 m to 25 m, the machining can be hardly performed by means of the so-called lathe turning machine and the like, and it is necessary to provide with an exclusive machining device dedicated to the outside surface machining of the longer length workpiece.

It is preferable that after the outside surface machining is performed to the mandrel bar, surface treatment is performed by the shot blasting to ensure good plating adhesiveness in re-plating, and the plating treatment is performed to form the Cr plated film on the surface of the mandrel bar. Then, it is more preferable that sharp projections on the surface of the mandrel bar are removed by light polishing using a belt grinder or the like.

EXAMPLES

First Example

The hollow shells were rolled by the mandrel mill rolling using mandrel bars (material grade thereof is SKD61 and its surface is subjected to a Cr plating treatment) each having an outside diameter of 248 mm and a length of 24 m, the mandrel bars being prepared to have surface defects graded in dimension to seven conditions (Test Nos. 1 to 7) shown below, and then the hollow shells were rolled into final hot-finished products through diameter-reducing processes. Through the ultrasonic test for the inner surface defects of the rolled products, "x" indicates the case in which a rejection-level defect was detected, "Δ" indicates the case in which a small defect(s) was detected although it is not to be rejected, and "o" indicates the case in which no defect was detected.

TABLE 1

| | Surface defect dimensions of mandrel bar | | | Type of surface | Defect level |
|---|---|---|---|---|---|
| Test No. | N (mm) | H (mm) | D (mm) | defect | of product |
| 1 | 10 | 1.5 | 0.3 | Comet tail | x |
| 2 | 20 | 3 | 0.5 | Comet tail | x |
| 3 | 25 | 5 | 2 | Comet tail | x |
| 4 | 10 | 1 | 0.1 | Comet tail | Δ |
| 5 | 70 | 1 | 0.5 | String defect | Δ |
| 6 | 70 | 2 | 0.1 | String defect | Δ |
| 7 | 10 | 0.5 | 3 | Heat crack | ○ |

As can be seen from the result shown in Table 1, with reference to dimensions of the surface defect generated on the surface of the mandrel bar, the length of the defect has no influence on the defect level of the product, and the defect level of the product becomes "x" when the opening width H is not less than 1.5 mm and the depth of relevant surface defect is not less than 0.3 mm.

With reference to the type of the surface defect, the defect referred to as a comet tail defect is generated in Test Nos. 1 to 4. The string-like abrasion defect is generated in Test Nos. 5 and 6, in which the surface defect in Test No. 5 is excessively narrow and the surface defect in Test No. 6 is excessively shallow. Therefore, in Test Nos. 5 and 6, the defect level does not reach the rejection. Since the surface defect in Test No. 7 is an excessively narrow heat crack, no surface defect is founded.

Second Example

The hollow shells were rolled under the following seven conditions by the mandrel mill rolling using mandrel bars (material grade is SKD61 and its surface is subjected to a Cr plating treatment) having an outside diameter of 248 mm and a length of 24 m, and then the hollow shells were rolled into final hot-finished products through diameter-reducing processes. Among prepared mandrel bars, two bars for each condition were repeatedly used to study the lifetime (the overall number of rolled tubes). The low alloy steel was used as the rolled tube material.

Condition 1

Comparative Example

The rolling was started using a new mandrel bar, and the mandrel bar was used until the surface of the mandrel bar was damaged to generate an inner surface defect(s) in the product.

Condition 2

Example A

For a mandrel bar where the surface defect with an opening width H of 3.0 mm and a depth D of 0.5 mm was generated on the surface thereof, after relevant surface defect was conditioned using a grinder, the plated film was removed by the plating melt using the alkali solution, and the finish-polishing and re-plating were performed, followed by the rolling again as a tool of like size. At this point, the conditioned length in a direction L1 was 25 mm, and the conditioned length in a direction L2 was 10 mm (L1/D=50 and L2/D=20).

Condition 3

Example B

For a mandrel bar where the surface defect with the same level as the condition 2 was generated on the mandrel bar, the same regeneration treatment as the condition 2 was performed to the mandrel bar, and the mandrel bar was used in the rolling as a tool of like size. At this point, the conditioned length in a direction L1 was 15 mm, and the conditioned length in a direction L2 was 15 mm (L1/D=30 and L2/D=30).

Condition 4

Example C

For a mandrel bar where the surface defect with the same level as the condition 2 was generated on the mandrel bar, the same regeneration treatment as the condition 2 was performed to the mandrel bar, and the mandrel bar was used in the rolling as the tool having the same size. At this point, the conditioned length in a direction L1 was 30 mm, and the conditioned length in a direction L2 was 5 mm (L1/D=60 and L2/D=10).

Condition 5

Example D

For a mandrel bar where the surface defect with the same level as the condition 2 was generated on the mandrel bar, the surface defect was not conditioned using a grinder and the plated film was removed by the plating melt using the alkali solution. And then, the finish-polishing and re-plating were performed, and the mandrel bar was used in the rolling as a tool of like size.

Condition 6

Comparative Example A

For a mandrel bar where the surface defect with an opening width H of 3.0 mm and a depth D of 0.5 mm was generated on the surface of the mandrel bar, the mandrel bar was directly used in the rolling.

Condition 7

Comparative Example B

For a mandrel bar where the surface defect with an opening width H of 5 mm and a depth D of 2.0 mm was generated on the surface of the mandrel bar, after the surface defect was conditioned using a grinder, the plated film was removed by the plating melt using the alkali solution, and the finish-polishing and re-plating were performed, followed by the rolling again as a tool of like size. At this point, a conditioned length in a direction L1 was 100 mm, and a conditioned length in a direction L2 was 40 mm (L1/D=50 and L2/D=20).

(Rolling Result: The Number of Rolling Passes)

The use of the mandrel bar under test was stopped at the time that the damage on the surface thereof became significant and the inner surface defect having the rejection level was detected in the ultrasonic test for the product to which diameter-reducing processes was performed. At this point, the mandrel bar was evaluated with the number of rolling passes.

Assuming that the number of rolling passes was set to 100 in the Conventional Example (condition 1), the number of rolling passes was 80 in the Example A (condition 2). Similarly, the numbers of rolling passes in Example B (condition 3), in Example C (condition 4) and in Example D (condition 5) were 50, 60 and 40, respectively.

On the other hand, the number of rolling passes was zero (as described in First Example) in Comparative Example A (condition 6). In Comparative Example B (condition 7), since a defective wall-thickness was generated in the product although the damage of the mandrel bar was not generated in the first pass, the number of rolling passes was also zero.

Thus, when the mandrel bar satisfying the conditions defined by the present invention is used, the lifetime of the mandrel bar can be largely extended since the relatively large number of rolling passes can be ensured.

INDUSTRIAL APPLICABILITY

According to the application method of a hot rolling Cr-plated mandrel bar, the hot rolling Cr-plated mandrel bar can repeatedly be applied to the mandrel mill rolling to achieve the life-extension of and the improvement of cost performance of the mandrel bar by adopting the regeneration treatment or downsizing treatment according to the conditions or configuration of the surface defect on the mandrel bar, even if relevant surface defect is generated on the mandrel bar by the mandrel mill rolling. Therefore, the application method of the present invention can widely be adopted as the efficient Mannesmann-mandrel mill tube making process.

What is claimed is:

1. An application method of a hot rolling Cr-plated mandrel bar repeatedly used in mandrel mill rolling by the Mannesmann tube making process, wherein when an opening width H of a surface defect generated on the mandrel bar by its use in the mandrel mill rolling is not less than 1.5 mm and a depth of the surface defect is in the range of 0.3 mm to less than 2.0 mm, a plated film is removed after said surface defect is conditioned, and finish-polishing or surface treatment is performed to the surface of the workpiece, followed by re-plating, thereby enabling the reclaimed mandrel bar to be used again as a tool of like size, and the surface of the mandrel bar is smoothly rounded off in conditioning said surface defect such that a conditioned length L1 (mm) in a longitudinal direction of the surface of the mandrel bar, a conditioned length L2 (mm) in a circumferential direction thereof, and a depth D (mm) of the surface defect thereof satisfy equations (1) and (2):

$$50 \leqq L1/D \quad (1), \text{ and}$$

$$20 \leqq L2/D \quad (2).$$

2. The application method of a hot rolling Cr-plated mandrel bar of claim 1, wherein said surface defect is caused by seizure generated during the mandrel mill rolling.

* * * * *